US006752697B1

(12) United States Patent
Stoeckgen et al.

(10) Patent No.: US 6,752,697 B1
(45) Date of Patent: Jun. 22, 2004

(54) APPARATUS AND METHOD FOR CHEMICAL MECHANICAL POLISHING OF A SUBSTRATE

(75) Inventors: Uwe Gunter Stoeckgen, Dresden (DE); Gerd Marxsen, Radebeul (DE)

(73) Assignee: Advanced Micro Devices, Inc., Austin, TX (US)

( * ) Notice: Subject to any disclaimer, the term of this patent is extended or adjusted under 35 U.S.C. 154(b) by 477 days.

(21) Appl. No.: 09/644,734

(22) Filed: Aug. 23, 2000

(51) Int. Cl.[7] ..... B24B 7/00

(52) U.S. Cl. ..... 451/56; 451/36; 451/41; 451/285; 451/443

(58) Field of Search ..... 451/56, 443, 36, 451/41, 285, 287, 288

(56) References Cited

U.S. PATENT DOCUMENTS 5,718,618 A * 2/1998 Guckel et al. ..... 451/41
5,961,377 A * 10/1999 Jeong ..... 451/56
6,116,997 A * 9/2000 Hakomori et al. ..... 451/444
6,135,868 A * 10/2000 Brown et al. ..... 451/443
6,193,587 B1 * 2/2001 Lin et al. ..... 451/56
6,200,207 B1 * 3/2001 Hsu ..... 451/443
6,241,581 B1 * 6/2001 Miyashita et al. ..... 451/41

* cited by examiner

*Primary Examiner*—Eileen P. Morgan
(74) *Attorney, Agent, or Firm*—Williams, Morgan & Amerson, P.C.

(57) ABSTRACT

The present invention is directed to a method and apparatus for performing polishing operations on substrates in an integrated circuit manufacturing environment. In one embodiment, the apparatus is comprised of a movable polishing platen, a polishing pad positioned on the platen, and a polishing arm that is adapted to receive and move the substrate relative to the polishing pad. The apparatus further comprises a first pad conditioner with a first conditioning surface that is positionable to allow contact between the first conditioning surface and the polishing pad, and a second pad conditioner with a second conditioning surface that is positionable to allow contact between the second conditioning surface and the polishing pad. In one embodiment, the method of the present invention comprises positioning a substrate to be polished in a polishing tool, supplying a polishing slurry to the tool, and providing relative movement between the substrate and a polishing pad. The method further comprises urging first and second pad conditioners into contact with the polishing pad, and providing a relative movement therebetween.

40 Claims, 1 Drawing Sheet

APPARATUS AND METHOD FOR CHEMICAL MECHANICAL POLISHING OF A SUBSTRATE

BACKGROUND OF THE INVENTION

1. Field of the Invention

The present invention relates to chemical mechanical polishing of substrates, and, more particularly, to an apparatus and a method that improves the conditioning process in chemical mechanical polishing procedures performed on substrates.

2. Description of the Related Art

Advances in the field of integrated circuit (IC) fabrication has generally resulted in steadily decreasing feature sizes of the components that form modem integrated circuits, or that are necessary to manufacture these integrated circuits. In particular, strong competition in the semiconductor market demands that all of the available wafer area should effectively be used for the production of integrated circuits. Due to ever decreasing feature sizes, it is desirable that defect counts on the semiconductor wafer be reduced below levels which were previously tolerable for previous circuit designs. This defect reduction enables the formation of integrated circuits with advanced circuit designs that use a higher percentage of the chip area.

Since modem circuit designs often require the formation of a plurality of layers on top of each other, and many photolithography steps accompanying the layer formation, it is desirable that the layers formed above the substrate have an approximately planar surface at various stages in the fabrication process in order to more efficiently form subsequent layers, such as metallization layers in the semiconductor device. As used in the present application, the concept of planarizing a substrate refers to, and should be understood to include, the planarization of an uppermost surface of a process layer formed above the substrate, as well as the planarization of a semiconducting substrate itself.

To enhance the overall planarity of a substrate, and to improve the immunity of the substrate to certain types of defects, a process commonly referred to as chemical mechanical polishing (CMP) has become a standard procedure in manufacturing integrated circuits. CMP is a process for improving the surface planarity of a substrate, e.g., of a semiconductor wafer, a process layer formed above the substrate, etc., and it involves the use of a mechanical pad polishing system with a chemically reactive slurry. The rate of material removed from the substrate is dependent on several factors, including among others, the chemicals and abrasives used in the slurry, the surface pressure at the polishing pad-substrate interface, the net motion between the substrate and the polishing pad at each point on the substrate, the temperature of the slurry, which is significantly affected by the amount of friction created by the net motion, the degree of saturation of the slurry with ablated particles, and the state of the polishing surface of the polishing pad.

Most polishing pads are formed of a cellular microstructure polymer material having numerous voids which are filled by the slurry during operation. During polishing operations, particles that have been removed from the substrate surface tend to accumulate in the slurry. As a result, as the operations continue, a densification of the slurry within the voids occurs. Consequently, the polishing rate tends to steadily decrease, thereby disadvantageously affecting reliability of the planarizing process of the substrate surfaces which, in turn, may result in additional circuit failures.

To overcome this problem, most CMP apparatuses use a polishing pad conditioner that "renews" the polishing surface of the pad. In known CMP systems, one conditioner per polishing platen is provided, wherein the exhausted surface of the polishing pad is ablated by the relatively hard material of the conditioner once the polishing rate is assessed, e.g., by an operator, to be too low. Alternatively, an "in-situ" conditioner is used which is in contact with the polishing pad while the substrate is polished. The first alternative leads to significant variations of the polishing rate due to the difference of the renewed surface of the pad compared to the exhausted surface used immediately before the conditioning. The in-situ process is not as effective in refreshing the pad surface as the former alternative, since a substantially softer conditioner material has to be used in order to not unduly shorten the life time of the polishing pad. As a result, process conditions have to be monitored more frequently or steadily, and adjusted accordingly to meet process requirements in an up-to-date integrated circuit production flow. Accordingly, it is necessary to employ a plurality of test or dummy wafers before and during various production steps to determine the removal rates and the efficiency of CMP systems. All of this testing results in an increased downtime and, hence, higher production costs.

The present invention is directed to a method of making a semiconductor device that solves, or at least reduces, some or all of the aforementioned problems.

SUMMARY OF THE INVENTION

The present invention is directed to a method and apparatus for performing polishing operations on substrates in an integrated circuit manufacturing environment. In one embodiment, the apparatus is comprised of a movable polishing platen, a polishing pad positioned on the platen, and a polishing arm that is adapted to receive and move the substrate relative to the polishing pad. The apparatus further comprises a first pad conditioner with a first conditioning surface that is positionable to allow contact between the first conditioning surface and the polishing pad, and a second pad conditioner with a second conditioning surface that is positionable to allow contact between the second conditioning surface and the polishing pad. In one embodiment, the method of the present invention comprises positioning a substrate to be polished in a polishing tool, supplying a polishing slurry to the tool, and providing relative movement between the substrate and a polishing pad. The method further comprises urging first and second pad conditioners into contact with the polishing pad, and providing a relative movement therebetween.

BRIEF DESCRIPTION OF THE DRAWINGS

The invention may be understood by reference to the following description taken in conjunction with the accompanying drawings, in which like reference numerals identify like elements, and in which.

Figure 1:
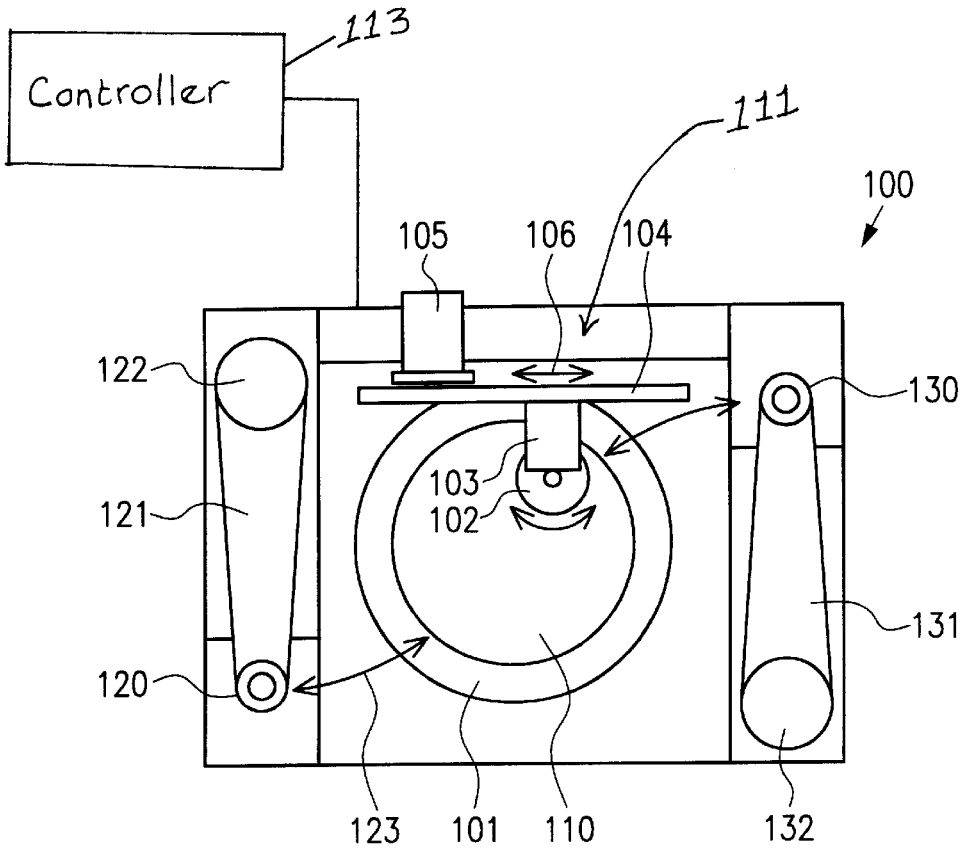
FIG. 1 is a schematic top view of one embodiment of the apparatus in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to FIGS. 1–2. The relative sizes of the various components depicted in the drawings may be exaggerated or reduced as compared to the size of those components on an actual apparatus or system. Nevertheless, the attached drawings are included to describe and explain illustrative examples of the present invention.

In general, the present invention is directed to a method and apparatus for chemically mechanically polishing a substrate. As will be readily apparent to those skilled in the art upon a complete reading of the present application, the present method is applicable to a variety of technologies, e.g., NMOS, PMOS, CMOS, etc., and is readily applicable to a variety of devices, including, but not limited to, logic devices, memory devices, etc.

FIG. 1 shows a schematic, top-view of a first embodiment of an apparatus in accordance with one illustrative embodiment of the present invention. As shown therein, a CMP apparatus 100 comprises a rotatable polishing platen 101 having a polishing pad 110 disposed thereon. The CMP apparatus 100 further includes a positioning arm 111 for holding and positioning the substrate during polishing operations. In the depicted embodiment, the positioning arm 111 is comprised of a rotatable member 102 for receiving and rotating a substrate that is supported and driven by a rotating means 103. The rotating means 103 is, in turn, supported by a supporting means 104 that is connected to a driving means 105. The driving means 105 allows movement of the supporting means 104 in a direction as indicated by the arrow 106. Of course, the present invention should not be considered limited to the illustrative structures depicted in FIG. 1.

The CMP apparatus 100 further comprises a first pad conditioner 120 mounted on a swing arm 121 that is supported by a swing arm driving means 122. The first pad conditioner 120 is movable in the direction as indicated by arrow 123 so that the first pad conditioner 120 may be positioned over the polishing pad 110. Adjacent to the polishing platen 101, a second pad conditioner 130 is provided. The second pad conditioner 130 is mounted on a second swing arm 131 that is supported by a positioning means 132 in such a manner that the second pad conditioner 130 may be positioned over the polishing pad 110. Moreover, the positioning means 132 is constructed so as to allow contact of the second pad conditioner 130 with the polishing pad 110, thereby applying a required pressure to the second pad conditioner 130. The second swing arm 131 may additionally comprise a means for rotating the second conditioner 130 when it is in contact with the polishing pad 110. Although not depicted in the drawings, the various drive means and rotating means discussed above, e.g., the driving means 105, the swing arm driving means 122 and the positioning means 132, may be comprised of a variety of components, such as one or more electrical, pneumatic, or hydraulic motors, and a plurality of interrelated gears and linkages to allow the components of the CMP apparatus 100 to move in the manner described herein. Moreover, the second pad conditioner 130 may be operated independently from the first pad conditioner 120 in the apparatus, i.e., the second pad conditioner 130 may be mechanically decoupled from the first pad conditioner 120.

As shown in FIG. 1, a controller 113 is used to control the operations of the CMP apparatus 100. The controller may be resident on the CMP apparatus 100, it may be a stand-alone device, or it may be part of an overall operating system in an integrated circuit manufacturing facility.

In the illustrated embodiment, the controller 113 is a computer programmed with software to implement the functions described. However, as will be appreciated by those of ordinary skill in the art, a hardware controller (not shown) designed to implement the particular functions may also be used. Moreover, the functions of the controller described herein may be performed by one or more processing units that may or may not be geographically dispersed. Portions of the invention and corresponding detailed description are presented in terms of software, or algorithms and symbolic representations of operations on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" or "displaying" or the like, refer to the actions and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In operation, a substrate, e.g., a semiconductor wafer having a process layer formed thereabove, is supplied to the rotatable member 102 by an appropriate means (not shown) or by an operator. A chemically reactive slurry is then provided to the polishing pad 110 by a slurry supply which is not shown in FIG. 1. Thereafter, the substrate is urged into contact with the polishing pad 110 so as to initialize the planarization of the surface of the substrate. For this purpose, the substrate is typically rotated by the rotating means 103 at a predefined angular velocity. The polishing platen 101 is also rotated such that relative motion is created between the substrate and the polishing pad 110, the magnitude of which depends on the respective angular velocities of the substrate and the polishing platen 101, and the position of the rotatable member 102 with respect to the polishing platen 101. This relative position may be changed during the polishing process by actuating the driving means 105 of the polishing arm 111. The positioning arm 111 comprised of, for example, the driving means 105, the supporting means 104, and the rotating means 103, is constructed in such a manner that any desired pressure can be applied to the substrate so as to properly adjust a polishing rate of the process.

As previously mentioned, the applied slurry causes a chemical reaction at the surface of the substrate and, hence, accelerates the performance of the polishing process. Especially when an oxidizing slurry is used, the temperature rise caused by the friction between the polishing pad 110 and the substrate promotes the chemical reaction and, hence, further increases the polishing rate.

Since the voids within the polishing pad 110 are increasingly filled with slurry that has absorbed some of the particles ablated from the substrate, the efficiency of the polishing process decreases over time. To counter this non-advantageous effect, the upper, polishing surface of the polishing pad 110 has to be conditioned, i.e., the slurry containing the absorbed particles must be removed, at least to some degree, from the voids in the polishing pad 110 on a periodic or random basis. For this purpose, the first pad conditioner 120 is moved over and brought into contact with conditioning pad 110. The first pad conditioner 120 has a first conditioning surface which may comprise a diamond containing disk or an ultrasonic sound source, or any other appropriate means for removing or reducing the amount of the slurry in the voids of the polishing pad 110, such as a vibrating mechanism as used in this embodiment. The conditioning with the first pad conditioner 120 may be performed by moving the first pad conditioner 120 periodically into contact with the polishing pad 110, or by placing the first pad conditioner 120 constantly in contact with the polishing pad 110 while the substrate is being polished. For example, the first pad conditioner 120 may be placed into contact with the polishing pad 110 after a set number of substrates have been polished, after it is determined that the removal rate using the polishing pad 110 is unacceptable, or after some other preselected period of time, etc.

Each portion of the polishing pad 110 may be conditioned consecutively in short time intervals in that the position of the first pad conditioner 120 may be steadily varied in the radial direction, i.e., the first pad conditioner 120 may be moved back and forth across the polishing pad 110. Nevertheless, a significant change in the process parameters of the polishing operation occurs when the substrate is removed from the polishing pad 110 since, at this time, the material ablated from the substrate is no longer accumulated in the voids of the polishing pad 110. In particular, when, for whatever reason, further process wafers cannot be supplied to the CMP apparatus 100, the process conditions, such as temperature and the consistency of the slurry, may also change or vary. In such a situation, it may be the case that an initial test wafer run has to be performed in order to readjust the corresponding process parameters. In this case, the conditioning surface of the second pad conditioner 130 may be comprised of a material that is substantially the same, or at least has the same polishing characteristics, as the material which will be polished-off or removed from the substrate. Therefore, when the second pad conditioner 130 is in contact with the conditioning pad 110 during the absence of a substrate, the process conditions can be kept relatively stable.

The first conditioning surface of the first pad conditioner 120 may be comprised of a hard polishing material, such as diamond, and the first pad conditioner 120 may only be brought into contact with the polishing pad 110 after a certain time period has elapsed, or after a certain number of substrates have been polished. In that situation, the second pad conditioner 130 may be maintained in essentially constant contact with the polishing pad 110, wherein the second conditioning surface of the second pad conditioner 130 is adapted to carry out an "intermediate" conditioning between the phases when the first pad conditioner 120 essentially completely renews the polishing surface of polishing pad 110. For this purpose, the second conditioning surface of the second pad conditioner 130 may be of a comb-like structure made of a material such as silicon.

Figure 2:
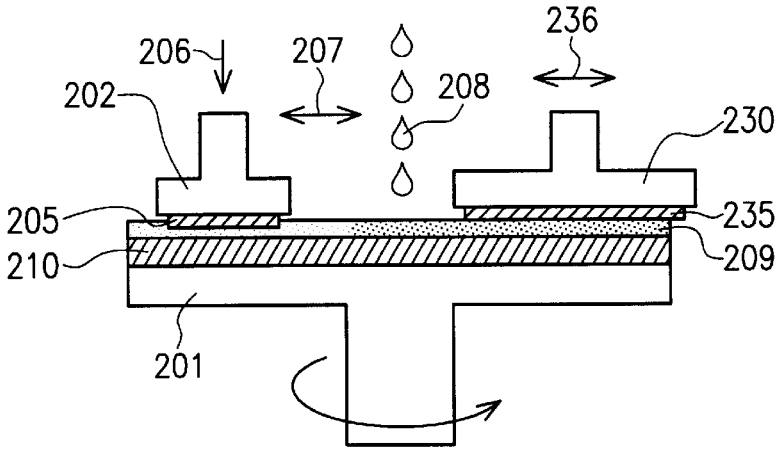
FIG. 2 is a schematic side view of another embodiment depicting a specific operational state.

FIG. 2 shows a schematic side view of another illustrative embodiment of the present invention. As shown therein, a polishing platen 201 carries a polishing pad 210. A slurry 208 is supplied to the polishing pad 210 and forms a slurry layer 209 on top of the polishing pad 210. A substrate 205 is mounted on a rotatable member 202 to which a downforce is applied, as indicated by an arrow 206. A second pad conditioner 230, having a second conditioning surface 235, is also provided. The second pad conditioner 230 may be movable in a radial direction with respect to the rotatable polishing platen 201, as is indicated by an arrow 236. The present embodiment, however, may be put into practice with or without the ability to radially move the second conditioner 230 as well. The diameter of the second conditioning surface 235 may be substantially larger than the diameter of the substrate 205. For example, the second conditioning surface 235 may have a diameter ranging from approximately 100–300 mm. Furthermore, the second conditioning surface 235 may be configured as a disk, a ring, or any other appropriate geometrical element so as to achieve the required conditioning effect. In one illustrative embodiment, the second conditioning surface 235 has a disk configuration.

In operation, the second pad conditioner 230 prepares a relatively large area of the polishing pad 210 and provides relatively constant conditions for the substrate 205 to be polished when the substrate is moved in a radial direction, as indicated by an arrow 207. The angular velocity of the rotatable member 202, and the pressure applied thereto, are initially adjusted so as to result in the required polishing rate. In this embodiment, performance is enhanced when the second pad conditioner 230 is constantly in contact with polishing pad 210. However, significant improvement of system stability is still attained even when the second pad conditioner 230 is brought into contact with the polishing pad 210 during the time when substrates are absent or being replaced.

The structure of second conditioning surface 235 may be designed such that an enhanced transport of particles polished off the substrate is insured. This may be accomplished by a comb-like structure having an appropriate pitch. Moreover, the second conditioning surface 235 may be made of a material which is substantially identical to the one that has to be polished off the substrate, e.g., a metal, a silicon compound, etc. Consequently, the process parameters of the polishing operation, such as temperature, the amount of ablated particles to be absorbed by the slurry, etc., are substantially determined by the second conditioner 230. This especially holds for a second conditioning surface 235 that is substantially larger than the surface of the substrate. Periodical or permanent refreshing of the polishing pad 210 by a first conditioner (not shown in FIG. 2) will lead to a variation of the density of absorbed particles in the slurry. This will result in a more stable polishing process as compared to a system having only one conditioner.

As a result, the employment of a second pad conditioner 230, according to one illustrative embodiment of the present invention, provides a process equilibrium and/or a more steady process. Accordingly, the necessity of initializations in chemical processes belonging to the entire CMP process, and the stabilization of process parameters over the polishing time is reduced. As a consequence, initial and/or other runs of test wafers for the CMP process become obsolete.

Moreover, the present invention has been described with reference to a polishing apparatus 100 that employs a rotatable polishing platen 101 and a rotatable means 103. The present invention, however, may be applied to a system in which the substrate and the polishing platen 101 are moved relatively to each other in an approximately linear movement, or in any other type of appropriate motion. The first and second pad conditioners 120, 130 may also be rotated or moved linearly, or in any other appropriate way, that does not interfere with the motion of the remaining system. In some cases, it may be advantageous to provide a "mixture" of relative motion, that is, the first pad conditioner 120 may be rotated and the second pad conditioner 130 may be linearly moved, and vice versa, while the polishing platen 101 may be rotated or moved linearly with respect to the substrate.

By the provision of a second pad conditioner per polishing platen, which is brought into contact with the polishing pad at least during those intervals in the process in which the polished substrate is replaced by another substrate to be polished, the operation parameters can be maintained in a more stable manner than is possible in the commonly-used CMP apparatus having merely one conditioner per platen. Since the present invention allows the conditioning of the polishing pad at least after every substrate, the slurry does not have an opportunity to deposit or become hard or dense in the cellular structure of the polishing pad. To this end, the material and the surface structure of the second conditioning surface may appropriately be selected so as to most effectively delay the accumulation of particles removed from the substrate within the voids of the polishing pads. After processing a plurality of substrates, the finally exhausted surface of the polishing pad may be renewed by the first conditioning surface of the first pad conditioner. As a result, the present invention provides an improved polishing uniformity during pad conditioning.

This allows an independent selection of specific process parameters for the second conditioner such as relative speed between the polishing pad and the second pad conditioner and pressure applied to the second pad conditioner. In particular, when a second pad conditioner according to the present invention is provided in combination with an in-situ first pad conditioner, the configuration and process parameters of the two pad conditioners may be selected so as to result, in combination, in an optimized conditioning uniformity. For instance, the first conditioning surface of the first pad conditioner may comprise an ultrasonic sound source, whereas the second conditioning surface of the second pad conditioner is adapted to mechanically act on the surface of the polishing pad. As an overall result, particles are removed most efficiently and a stable pad surface for a large number of substrates is obtained.

One embodiment of the methods disclosed herein comprises an apparatus for chemically mechanically polishing a substrate, comprising a movable polishing platen; a polishing pad positioned on said platen; a positioning arm, said arm adapted to receive and move said substrate relative to said polishing pad and to support said substrate when said substrate is in contact with said pad; a first pad conditioner having a first conditioning surface, said first pad conditioner being positionable to allow contact between said first conditioning surface and said polishing pad; and a second pad conditioner having a second conditioning surface, said second pad conditioner being positionable to allow contact between said second conditioning surface and said polishing pad.

According to another aspect of the present invention, there is provided another method of chemically mechanically polishing of a substrate using an apparatus having a first pad conditioner with first conditioning surface and a second pad conditioner having a second conditioning surface. The method comprises the steps of: (a) supplying a substrate having a surface with a material thereon, wherein at least a portion of the material is to be polished off the substrate to planarize the surface; (b) supplying a slurry to a polishing pad; (c) bringing the surface of the substrate into contact with the polishing pad; (d) moving the surface of the substrate and the polishing pad relative to each other, thereby maintaining the contact; (e) disengaging the substrate from contact with the polishing pad; (f) urging the second conditioning surface into contact with the polishing pad after the substrate is disengaged from contact with the pad, thereby stabilizing process conditions; (g) repeating the steps (a)–(f) until a polishing rate of a substrate drops below a predefined value; and (h) after reaching the predefined value, bringing the first conditioning surface into contact with the polishing pad to condition a surface of the polishing pad to re-establish the process conditions.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

(a) providing a polishing tool comprised of a polishing pad, a first pad conditioner having a first conditioning surface, and a second pad conditioner having a second conditioning surface, wherein said second conditioning surface is comprised of a material that may be polished off more easily than a material to be polished off said substrate;

(b) positioning a substrate in said tool and in contact with said polishing pad;

(c) supplying a slurry to at least said polishing pad;

(d) providing relative movement between said polishing pad and said substrate;

(e) disengaging said first substrate from contact with said pad;

(f) urging said second conditioning surface into contact with said polishing pad after disengaging said first substrate from contact with said pad, and providing relative movement between said second conditioning surface and said pad;

(g) repeating steps (b)–(f) with additional substrates until such time as a polishing rate of a substrate is less than a predefined value; and (h) after said polishing rate reaches said predefined value, urging said first conditioning surface into contact with said polishing pad and providing relative movement between said first conditioning surface and said pad.

2. The method of claim 1, wherein supplying a slurry to at least said polishing pad comprises supplying a chemically reactive slurry to at least said polishing pad.

3. The method of claim 1, wherein said first and second conditioning surfaces are in contact with said pad at the same time at least at some point during a polishing operation performed on at least one of said additional substrates.

4. The method of claim 1, wherein urging said first pad conditioner into contact with said polishing pad is performed independently of urging said second pad conditioner into contact with said polishing pad.

5. The method of claim 1, wherein urging said second pad conditioner into contact with said polishing pad is performed independently of urging said first pad conditioner into contact with said polishing pad.

6. The method of claim 1, wherein said relative movement between said first conditioning surface and said pad is at least one of a rotational and an approximately linear relative movement.

7. The method of claim 1, wherein said relative movement between said second conditioning surface and said pad is at least one of a rotational and an approximately linear relative movement.

8. An apparatus for chemically mechanically polishing a substrate, comprising:

a movable polishing platen;

a polishing pad positioned on said platen;

a positioning arm, said arm adapted to receive and move said substrate relative to said polishing pad and to support said substrate when said substrate is in contact with said pad;

a first pad conditioner having a first conditioning surface, said first pad conditioner being positionable to allow contact between said first conditioning surface and said polishing pad; and a second pad conditioner having a second conditioning surface, said second pad conditioner being positionable to allow contact between said second conditioning surface and said polishing pad, wherein said substrate comprises a material to be polished off said substrate by said apparatus, and wherein said second conditioning surface is comprised of a material that may be polished off more easily than the material to be polished off said substrate.

9. The apparatus of claim 8, wherein said movable polishing platen comprises a rotatable polishing platen.

10. The apparatus of claim 8, wherein said polishing pad has a generally circular configuration.

11. The apparatus of claim 8, wherein said first pad conditioner is comprised of at least one of a diamond containing disk and an ultrasonic sound source.

12. The apparatus of claim 8, further comprising a slurry reservoir for containing a slurry to be supplied to at least said polishing pad.

13. The apparatus of claim 8, further comprising a control unit for controlling the operation of said apparatus.

14. The apparatus of claim 8, wherein said second pad conditioner is mechanically decoupled from the first pad conditioner.

15. The apparatus of claim 8, wherein said second conditioning surface is provided in the form of at least one of a ring and a disk.

16. The apparatus of claim 8, wherein said second conditioning surface has an area that is greater than an area of said substrate to be polished.

17. The apparatus of claim 8, further comprising means for providing relative motion between said polishing pad and said first and second pad conditioners.

18. The apparatus of claim 8, further comprising means for moving said positioning arm relative to said polishing pad.

19. The apparatus of claim 8, further comprising means for moving said first pad conditioner into contact with said polishing pad.

20. The apparatus of claim 8, further comprising means for moving said second pad conditioner into contact with said polishing pad.

21. An apparatus for chemically mechanically polishing a substrate, comprising:

a movable polishing platen;

a polishing pad positioned on said platen;

a positioning arm, said arm adapted to receive and move said substrate relative to said polishing pad and to support said substrate when said substrate is in contact with said pad;

a first pad conditioner having a first conditioning surface, said first pad conditioner being comprised of at least one of a diamond containing disk and an ultrasonic sound source and being positionable to allow contact between said first conditioning surface and said polishing pad;

a second pad conditioner having a second conditioning surface, said second pad conditioner being positionable to allow contact between said second conditioning surface and said polishing pad, wherein said substrate comprises a material to be polished off said substrate by said apparatus, and wherein said second conditioning surface is comprised of a material that may be polished off more easily than the material to be polished off said substrate; and a control unit for controlling the operation of said apparatus.

22. The apparatus of claim 21, wherein said movable polishing platen comprises a rotatable polishing platen.

23. The apparatus of claim 21, wherein said polishing pad has a generally circular configuration.

24. The apparatus of claim 21, further comprising a slurry reservoir for containing a slurry to be supplied to at least said polishing pad.

25. The apparatus of claim 21, wherein said second pad conditioner is mechanically decoupled from the first pad conditioner.

26. The apparatus of claim 21, wherein said second conditioning surface is provided in the form of at least one of a ring and a disk.

27. The apparatus of claim 21, wherein said second conditioning surface has an area that is greater than an area of said substrate to be polished.

28. The apparatus of claim 21, further comprising means, for providing relative motion between said polishing pad and said first and second pad conditioners.

29. The apparatus of claim 21, further comprising means for moving said positioning arm relative to said polishing pad.

30. The apparatus of claim 21, further comprising means for moving said first pad conditioner into contact with said polishing pad.

31. The apparatus of claim 21, further comprising means for moving said second pad conditioner into contact with said polishing pad.

32. A method, comprising:

providing a polishing tool comprised of a polishing pad, a first pad conditioner having a first conditioning surface, and a second pad conditioner having a second conditioning surface;

positioning a substrate in said tool and in contact with said polishing pad, said substrate comprised of a material to be polished off said substrate;

supplying a slurry to at least said polishing pad;

providing relative movement between said polishing pad and said substrate;

urging said first conditioning surface into contact with said polishing pad and providing relative movement between said first conditioning surface and said pad; and urging said second conditioning surface into contact with said polishing pad and providing relative movement between said second conditioning surface and said pad, wherein said second conditioning surface is comprised of a material that may be polished off more easily than the material to be polished off said substrate.

33. The method of claim 32, wherein supplying a slurry to at least said polishing pad comprises supplying a chemically reactive slurry to at least said polishing pad.

34. The method of claim 32, wherein said first and second conditioning surfaces are in contact with said pad at the same time at least at some point during a polishing operation.

35. The method of claim 32, wherein urging said first pad conditioner into contact with said polishing pad is performed independently of urging said second pad conditioner into contact with said polishing pad.

36. The method of claim 32, wherein urging said second pad conditioner into contact with said polishing pad is performed independently of urging said first pad conditioner into contact with said polishing pad.

37. The method of claims 32, wherein said relative movement between said first conditioning surface and said pad is at least one of a rotational and an approximately linear relative movement.

38. The method of claim 32, wherein said relative movement between said second conditioning surface and said pad is at least one of a rotational and an approximately linear relative movement.

39. The method of claim 32, wherein said second conditioning surface is urged into contact with said pad until such time as a removal rate achieved by a polishing operation performed in the polishing tool falls below a predefined value.

40. The method of claim 32, wherein said first conditioning surface is engaged with said polishing pad after a removal rate falls below a predefined value.

* * * * *